United States Patent [19]

Joly et al.

[11] Patent Number: 4,937,903

[45] Date of Patent: Jul. 3, 1990

[54] BED COVERING APPARATUS

[75] Inventors: Cyril B. Joly, Winchester; David N. B. Joly, London, both of United Kingdom

[73] Assignee: Dormair Limited, England

[21] Appl. No.: 216,637

[22] PCT Filed: Dec. 24, 1986

[86] PCT No.: PCT/GB86/00804

§ 371 Date: Jul. 1, 1988

§ 102(e) Date: Jul. 1, 1988

[87] PCT Pub. No.: WO87/04066

PCT Pub. Date: Jul. 16, 1987

[51] Int. Cl.[5] ..... A47C 21/04

[52] U.S. Cl. ..... 5/414; 5/284; 5/505; 5/423

[58] Field of Search ..... 5/284, 421, 423, 505, 5/506, 507, 414

[56] References Cited

U.S. PATENT DOCUMENTS

| | | | |
|---|---|---|---|
| 800,779 | 10/1905 | Woodward | 5/284 |
| 1,395,912 | 11/1921 | Ferentzi | 5/284 |
| 1,669,683 | 5/1928 | Temple et al. | 5/284 |
| 2,350,618 | 6/1944 | Johnson . | |
| 2,579,964 | 12/1951 | Reynolds | 5/421 |
| 2,695,413 | 11/1954 | Maat | 5/284 |
| 3,680,158 | 8/1972 | Speed | 5/505 |
| 4,489,451 | 12/1984 | Neely | 5/504 |
| 4,644,599 | 2/1987 | Wolcott | 5/504 |

FOREIGN PATENT DOCUMENTS

| | | | |
|---|---|---|---|
| 72843 | 1/1894 | Fed. Rep. of Germany | 5/505 |
| 1085791 | 10/1967 | United Kingdom . | |
| 1311461 | 3/1973 | United Kingdom . | |
| 1386249 | 3/1975 | United Kingdom | 5/421 |
| 1481888 | 1/1977 | United Kingdom . | |

*Primary Examiner*—Eric K. Nicholson

*Attorney, Agent, or Firm*—Allegretti & Witcoff, Ltd.

[57] ABSTRACT

A bed covering apparatus comprising a foot board (1) and L-shaped support arms attached to an outside surface of the foot board and above a mattress (8). A quilt (2) is supported by the long arm portion of the L shaped arms (11) and tucked under the mattress by means of side pieces. An air recirculating unit is provided on the foot board (1) with a heater (24) for heating the air space (21) between the mattress and the quilt.

18 Claims, 2 Drawing Sheets

BED COVERING APPARATUS

THE FIELD OF THE INVENTION

The present invention relates to a bed covering apparatus.

THE BACKGROUND OF THE INVENTION

British patent specification No. 1,085,791, dated 16th April 1964, describes:

"An apparatus for providing a desired atmosphere in a sleeping space, comprising frame members arranged to support, when said apparatus is in use, a cover which co-operates with a bed to define a sleeping space for the body and legs of a person while leaving the head of the person outside the sleeping space, temperature-changing means for heating and/or cooling said space, and supporting means supporting said frame members, the frame members being longitudinally adjustable to adjust the length of said sleeping space, and said supporting means being vertically adjustable to raise and lower said frame members."

Experience proved this apparatus to be impractical because whatever fabric was used for the cover, a very considerable volume of air, usually heated, was required to be blown into the sleeping space by the heating means. This was because of the porosity of the cover. Even heavy canvas was tried, but still problems were experienced. The apparatus was found to have to be too bulky, powerful and expensive to be practical.

Due to continuing incentive for energy saving, we have reconsidered the earlier invention. In the intervening time, many new light-weight materials have been developed. In particular light-weight insulating covers are now available.

The significance of the availability of these is that we have been able not only to introduce routine improvements by using lighter weight structural materials, we have also been able to make innovative changes in the earlier apparatus.

In particular, we have now been able to enclose the space between the cover and the mattress. This has resulted in the ability to recirculate air flow from and back to this space.

THE INVENTION

The object of the invention is to provide an improved bed covering apparatus.

According to the present invention there is provided a bed covering apparatus comprising:

a foot board adapted to be arranged in use across a bed at its foot;

a cover support attached to the foot board to extend along the bed above its mattress; engagement means for engaging the foot board to a frame of the bed in an upright position, whereby the foot board holds the cover support above the mattress;

a thermally insulating cover, the cover in use being connected to the foot board at top and side edges thereof, supported on the cover support above the bed, and detachably arranged adjacent to the mattress from the foot to the shoulder region thereof; and air recirculating means mounted on the foot board for recirculating air within space between the mattress and the cover.

Various materials are envisaged as possible for the thermally insulating cover. It may be thermally insulating by restricting convective heat transfer or radiant heat transfer or both. It could be of a laminar material such as a metallized, survival blanket for complete convection resistance with radiation resistance in addition or a cheap synthetic laminar material for complete convection resistance alone. However for ease of washing and in order to enable the bed occupant's body to perspire without undesirable condensation on the cover, this is preferably slightly permeable, that is to say that it does not form a barrier impermeable to convective heat transfer. The preferred cover is a quilt of outer layers of woven fabric and an inner layer of non-woven, fibrous filling. The inner layer may incorporate reflective material to enhance its insulating material, in addition to trapped air pockets to inhibit convection. Such a quilted material may be obtained from Flectalon Limited of Pontypridd, Wales and is sold under the trade mark FLECTALON. This quilt has no laminar layer, but is effectively impermeable in keeping the atmosphere within the covered space separate from the surrounding atmosphere.

The cover is preferably connected to the foot board by openable means able to resist convection, conveniently hook and loop fastening strips as sold under the registered trade mark VELCRO. Single thickness woven textile edge pieces attached to the cover may be provided at the edges of the cover for tucking under the mattress in the manner of sheets and blankets—for insulating arrangement along the bed.

To provide closure of the space between the cover and the shoulders of the bed occupant a washable, quilted, insulated, neckpiece of similar material as the quilt cover can be provided, connected to the quilt cover by VELCRO fastening strip. The neckpiece also can have single sheet edge pieces.

For engagement to the frame of the bed, the foot board conveniently has a bottom edge supportable on the underpart of the bed so that the foot board of the apparatus may replace the bed's normal foot board, or be added where no foot board normally exists. If for any reason it is desirable to retain the bed's normal foot board, the foot board of the covering apparatus may be fitted on the mattress side of the normal foot board.

As described in the earlier application the frame members are preferably telescopic for extension as far as the shoulder region of the occupant or retraction to enable an occupant of the bed to sit up whilst partly covered.

The air recirculating means will normally incorporate a thermostatically controlled low wattage heater and a fan. However it is envisaged that for certain uses the heater may not be used, the fan providing a movement of air which will cool to some extent. Again where the apparatus is for covering a bed occupant with certain conditions a humidifier may be incorporated. For bed occupants requiring special cooling a separate fan may be incorporated.

THE DRAWINGS

To help understanding of the invention, two specific embodiments thereof will now be described by way of example and with reference to the accompanying drawings, in which.

THE FIRST EMBODIMENT

Figure 1:
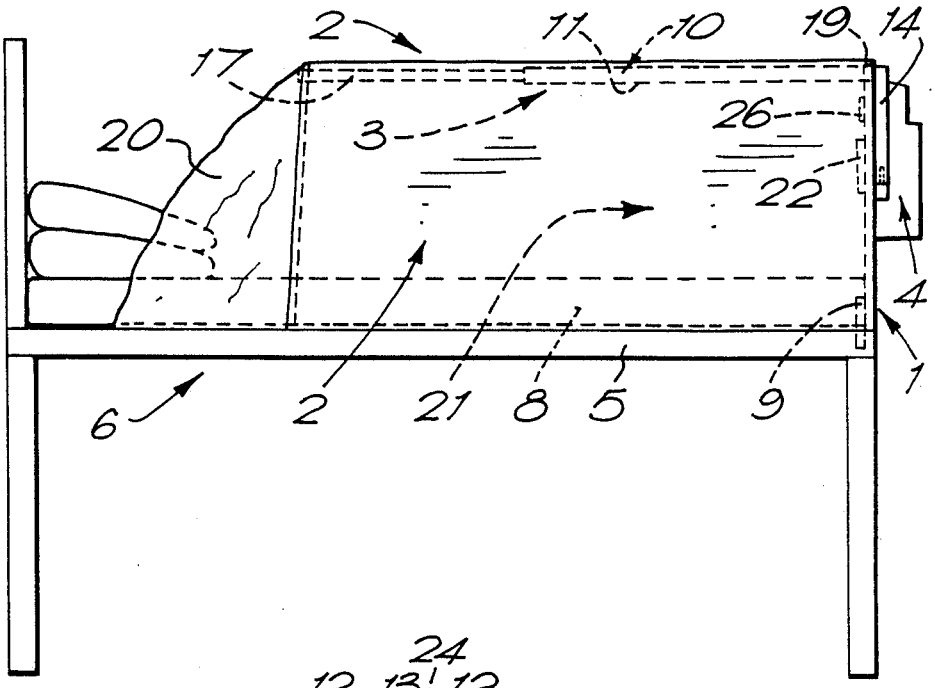
FIG. 1 is a side view of bed covering apparatus of the invention, in use with a bed.
Figure 2:
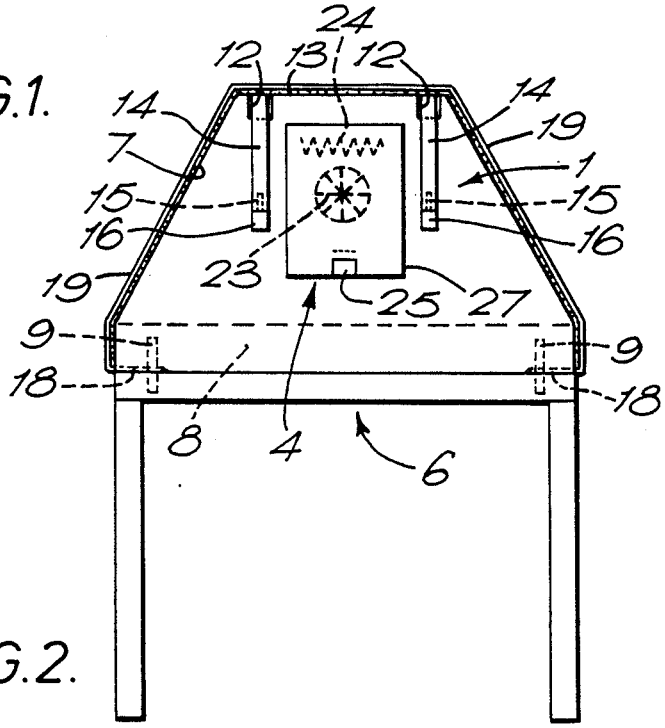
FIG. 2 is a view of the outside of the foot board.

The bed covering apparatus of the invention as shown in FIGS. 1 and 2 of the drawings essentially comprises a foot board 1, a cover 2, a cover support 3 attached to the foot board 1 and an air recirculating unit 4 carried on the foot board 1.

The foot board 1 rests at its bottom edge on the frame 5 of a bed 6, which is in itself conventional. The board 1 is generally rectangular with large triangular pieces cut away at its upper corners leaving sloping side edges 7; it is of chipboard suitably skinned. The board is arranged beyond a mattress 8 at the foot of the bed in the manner of a conventional foot board, which it replaces where such is normally provided on the bed. Depending lugs 9 are secured to the board for engagement in conventional housings in the bed whereby the board is held upright even under the tipping moment of the cover 2 and its support 3.

The cover support 3 includes two L members 10 of square steel tube suitably painted. The L members have long arms 11, which extend along the bed above the mattress from notches 12 close to the ends of a horizontal top edge 13 of the foot board 1. Short arms 14 of the L members extend down from the notches outside the foot board and receive short stubs of steel tube 15 carried on brackets 16 screwed to the outside of the foot board. Thus the short arms 14 are removably secured against the foot board 1 with the long arms 11 being held up above the mattress. The arrangement biasses the long arms 11 to extend at right angles to the foot board 1.

The long arms 11 telescopically accommodate round section extension members 17 which extend as far as about the shoulder region of an occupant. Here the extension members are braced apart by an interconnecting member (not shown). The cover 2 in the form of a lightweight synthetic material quilt as sold under the trade mark FLECTALON extends over the support members 11,17. The FLECTALON quilt comprises random flame retardant p.v.c. strips 1–3 mm wide and 15 mm thick covered by 200/250 angstron aluminium film within woven outer layers. Along the side edges of the cover 2 it is provided with single sheet edge piece 18 which can be tucked under the edges of the mattress 8, in the manner of a normal sheet. The cover is thus held taut between the members 11,17 and down from them to the edges of the mattress 8. Thus an occupant of the bed can turn over and lie however he/she pleases free from contact with the cover 2.

To the sloping edges 7 and top edge 13 of the foot board 1 is attached a VELCRO strip. The foot edge 19 of the cover 2, not including the edge pieces 18 is provided with a complementary VELCRO strip for securement of the cover 2 to the VELCRO strip on the foot board 1. At the head end of the cover it is connected, again by VELCRO strips to a quilted neck piece 20, which rests on the occupant's neck and/or shoulders in the manner of a sheet and can be tucked under the mattress using side pieces of single sheet, similar to those on the cover 2.

With the cover 2 being of a weight such as to provide a degree of thermal insulation similar or somewhat better than that normally associated with a duvet or sleeping bag, it, in conjunction with the foot board 1 and the mattress 8, substantially airtightly encloses the space 21 between the cover 2 and mattress 8. The space is thus largely insulated, but some extra heat has to be provided to add to that from a human body for the bed occupant to be comfortably warm, except when the ambient temperature is itself adequate. For this the heating and air recirculating unit 4 is provided on the outside of the foot board 1.

The unit has an air inlet through the foot board 1 which incorporates a replaceable nylon fabric air filter 22 from the space 21, a fan 23, a heater 24 of 100 watts, a thermostat 25 controlling the heater 24 and air outlet 26 back to the space 21. A housing 27 encloses the unit. Since the volume of air to be recirculated to the space 21 is small, the fan 23 is arranged to run slowly by being electrically supplied via a series resistor. Thus the occupant does not feel uncomfortable draughts.

In a test with a cover of 200 g/m FLECTALON quilt material, the heater was found to be ON 20% of the time under control of the thermostat to provide a comfortable temperature for a healthy individual. On account of the slow air movement and the absence of inflation from ambient air, there is no tendency for the cover 11 to be inflated or deflated. The VELCRO fastening strips and tucking in of the side pieces of the cover maintain the cover taut and substantially airtightly connected to the foot board and the mattress, whilst the neckpiece 20 prevents by its own weight any significant air flow to or from the space 21 at the shoulder region.

Electric power to the air recirculating unit 4 is conveniently at mains voltage, although low voltage may be employed. Conveniently the setting of the thermostat may be adjusted via a bedside control (not shown). This or a control knob (not shown) on the unit 4 may be adjusted in accordance with the heating requirement of each individual. A further control position enables the fan alone to be powered for use in hot conditions. This can provide a cooling flow of air with the neckpiece 20 open.

The Second Embodiment

Figure 3:
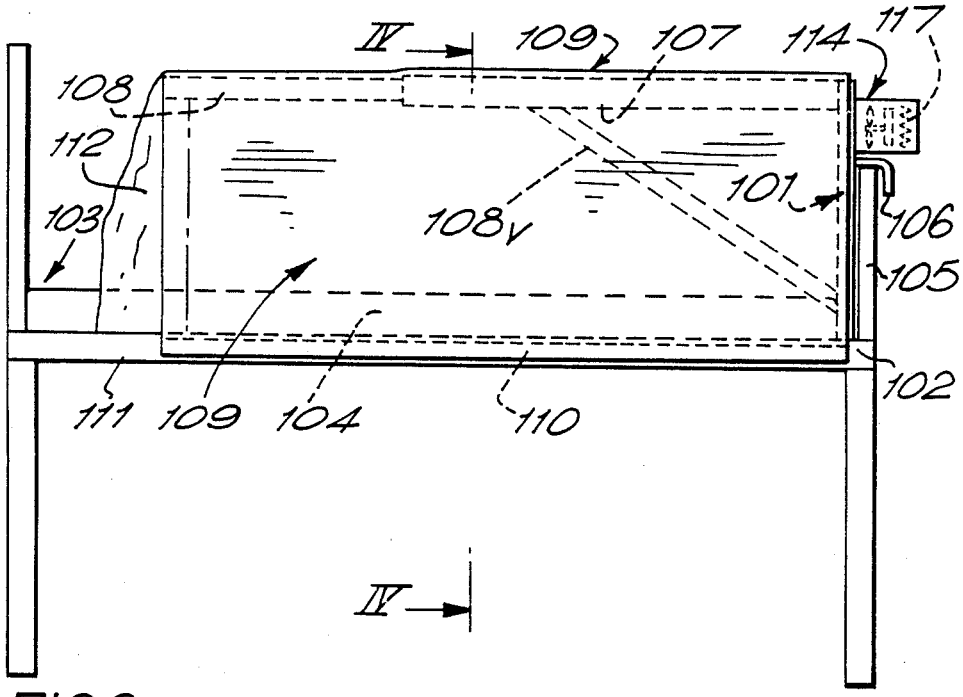
FIG. 3 is a side view of a second bed covering apparatus of the invention in use with a bed.
Figure 4:
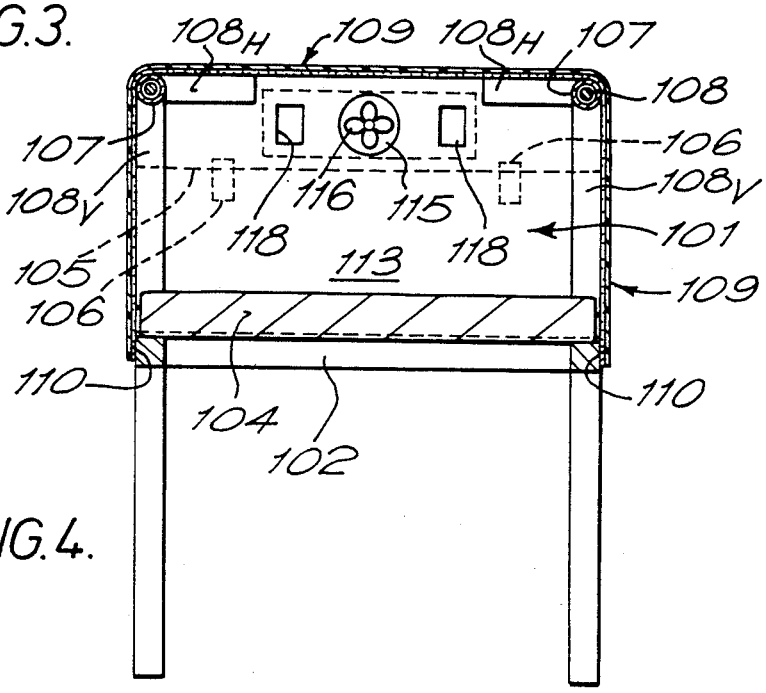
FIG.4 is a cross-sectional view on line IV—IV in FIG. 3.

The apparatus of FIGS. 3 and 4 has a generally-rectangular medium density fibreboard foot board 101 supported at its bottom edge on the frame 102 of the bed 103 between the mattress 104 and the foot board 105 of the bed itself. Clips 106 secure the foot board 101 of the apparatus to that of the bed so that it is upright and can support the other parts of the apparatus.

A pair of frame members 107 extend along the bed above its sides from top corners of the foot board 101. The frame members are supported by the foot board 101 with the aid of both vertical triangulation struts $108_V$ extending from part way along the members 107 to a lower part of the foot board 101 and horizontal triangulation struts $108_H$ in the corner between the members 107 and the top edge of the foot board 101.

The members 107 are hollow metal tubes, telescopically accommodating extension members 108 which extend as far as the shoulder region of the bed. A cover 109 in the form of a plastics material sheet, provided with a woven nylon overcover for appearance sake, extends over the frame members 107. Along side edges of the cover it is provided with VELCRO fastening strips 110. Complementary strips are provided on the longitudinals 111 of the bed frame. By interengaging the VELCRO strips, the cover is held taut between the members 107,108 and down from them to the longitudinals 111. Thus an occupant of the bed can turn over and lie however he pleases free from contact with the cover 109.

At the foot board 101 further VELCRO strips are provided for securing the cover 109 to the foot board. At the head end of the cover it is connected, again by VELCRO strips to a quilted cotton—or other fabric—neck piece 112, which rests on the occupant's neck or shoulders in the manner of a sheet and can be tucked under the mattress at its side edges.

The cover 109 in conjunction with the foot board 101 and the mattress 104 substantially impermeably encloses the space 113 between the cover and mattress. Although the space is thus largely insulated, there is nevertheless a small heat loss from it. The average human body dissipates 80 watts. In order to keep the air in the space 113 at a comfortable 90° F. a further 30 watts is typically required. For this a heating and air recirculating unit 114 is provided on the foot board.

The unit has an air inlet 115 from the space 113, a fan 116, a heater 117 in the form of a black heat element, and a pair of spaced air outlets 118. The fan 116 runs slowly since the amount of heat to be supplied to the space 113 is small. Thus the occupant does not feel uncomfortable draughts. Because of the slow air movement and the absence of inflation from ambient air, there is no tendency for the cover 109 to be inflated or deflated. The VELCRO fastening strips maintain the cover taut and substantially impermeably connected to the foot board and the bed.

Electric power to the unit 114 is conveniently at mains voltage, although, for added safety, 12 volts may be employed. Conveniently the output of the heater may be adjusted via a bedside control. This may be graduated in accordance with a degree of heating equivalent to none, one, two or three blankets, with a further position corresponding to the fan only and not the heater being powered for use in very hot conditions.

The advantages of the use of the above embodiments of the invention are that a sleeping space can be provided which has the following benefits:

each bed occupant can have an individually selected optimum temperature;

the clinical benefits can be expected to at least be:

treatment of hypothermia by safe and cheap means;

alleviation of pressure sores;

alleviation of discomfort caused by the weight of bedclothes;

reduction of the ambient temperature of wards and rooms affording greater comfort to bed occupants and those in attendance on them;

reduction in second ailments such as sinus troubles, catarrh, ear infections, respiratory problems, due to possible lowering of ward ambient temperature;

consequent saving of heating energy costs;

in hospitals and the like and other institutions considerable savings in the purchasing, accounting for, handling and storing of conventional bed clothes;

in hospitals and the like and other institutions considerable savings in the laundering of the resultant surplus of conventional bedclothes.

The invention is not intended to be restricted to the details of the above described embodiments which are for a single-bed width bed. For instance the bed may be of double-bed width. The air outlet 4 may be provided with an additional filter if desired. The FLECTALON quilt of the first embodiment could be replaced by a conventional, polyester quilt. However this is heavier.

We claim:

1. Bed covering apparatus for covering a bed having a mattress defining a foot region normally occupied by an occupant's feet and a shoulder region normally occupied by an occupant's shoulders comprising:

a foot board adapted to be arranged in use across the bed at the foot region, the foot board defining an outside surface facing away from the mattress;

a cover support attached to the foot board to extend along the bed above the mattress, the cover support comprising a pair of L-shaped members, each L-shaped member being defined by a long arm and a short arm, the long arm of each L member extending over the mattress and the short arm of each L-shaped member extending down the outside surface of the foot board, the lower end of each short arm being captive to the foot board for support of each long arm;

engagement means for engaging the foot board to a frame of the bed in an upright position, whereby the foot board holds the cover support above the mattress;

a thermally insulating cover, the cover in use being connected to the foot board at the top and side edges thereof, supported on the cover support above the bed, and detachably arranged adjacent the mattress from the foot region to the shoulder region thereof; and air recirculating means mounted on the foot board for recirculating air within the space between the mattress and the cover.

2. Bed covering apparatus according to claim 1, wherein the air recirculating means comprises a housing on the outside surface of the foot board, an air inlet through the foot board, an air outlet through the foot board and a fan within the housing for drawing air through the inlet from the space and back through the outlet to the space.

3. Bed covering apparatus according to claim 2, wherein the air recirculating means includes a heating element within the housing.

4. Bed covering apparatus according to claim 2, wherein the air inlet is provided with a filter.

5. Bed covering apparatus according to claim 2, wherein the air outlet is provided with a filter.

6. Bed covering apparatus according to claim 1, wherein the air recirculating means includes means for cooling.

7. Bed covering apparatus according to claim 1, wherein the cover has woven textile edge pieces for tucking under the mattress.

8. Bed covering apparatus according to claim 1, wherein location studs are provided on the outside surface of the foot board, notches are provided in the top edge of the foot board above the location studs, the long arms are received in the notches and the short arms receive the location studs at their lower terminal ends, the arrangement permitting ready dismounting of the L members.

9. Bed covering apparatus according to claim 1, wherein the insulating cover is adapted to resist convective heat loss from the space.

10. Bed covering apparatus according to claim 9 wherein the insulating cover is multilayered.

11. Bed covering apparatus according to claim 1, wherein the insulating cover is adapted to resist radiant heat loss from the space.

12. Bed covering apparatus according to claim 1, wherein the insulating cover is of quilted construction with fibrous filling.

13. Bed covering apparatus according to claim 12, wherein the fibrous filling is metallized for heat reflection.

14. Bed covering apparatus according to claim 1, wherein the cover is connectable to the foot board by openable means adapted to resist convective heat loss.

15. Bed covering apparatus according to claim 14, wherein the openable means comprises hook and loop fastening strips.

16. Bed covering apparatus according to claim 1, wherein the cover has a detachable neck piece.

17. Bed covering apparatus according to claim 1, wherein the engagement means comprises depending lugs secured to the foot board at a lower edge thereof for engagement in housings in the bed.

18. Bed covering apparatus according claim 1, wherein the engagement means comprises dips secured to the outside surface of the foot board for engagement with the foot board of the bed.

* * * * *